US009153871B2

(12) United States Patent
Park

(10) Patent No.: US 9,153,871 B2
(45) Date of Patent: Oct. 6, 2015

(54) PLANAR ANTENNA ASSEMBLY FIXED TO CEILING

(71) Applicant: Jinyoung Park, Seoul (KR)

(72) Inventor: Jinyoung Park, Seoul (KR)

( * ) Notice: Subject to any disclaimer, the term of this patent is extended or adjusted under 35 U.S.C. 154(b) by 0 days.

(21) Appl. No.: 14/061,854

(22) Filed: Oct. 24, 2013

(65) Prior Publication Data

US 2015/0116175 A1 Apr. 30, 2015

(51) Int. Cl.
*H01Q 9/16* (2006.01)

(52) U.S. Cl.
CPC ..... *H01Q 9/16* (2013.01)

(58) Field of Classification Search
CPC ..... H01Q 9/16
USPC ..... 343/806
See application file for complete search history.

(56) References Cited

U.S. PATENT DOCUMENTS

2004/0056802 A1* 3/2004 Hollister ..... 343/700 MS
2010/0029197 A1* 2/2010 Judd et al. ..... 455/11.1

* cited by examiner

*Primary Examiner* — Dameon E Levi
*Assistant Examiner* — Andrea Lindgren Baltzell
(74) *Attorney, Agent, or Firm* — Hauptman Ham, LLP

(57) ABSTRACT

Provided is a planar antenna assembly attached to a ceiling, in which a structure of an antenna assembly for a mobile communication repeater is developed into a planar shape, thereby improving interior aesthetics. The planar antenna assembly attached to the ceiling according to an embodiment of the present invention may improve electric characteristics of radio waves to improve call quality.

9 Claims, 11 Drawing Sheets

Horizontal Pattern

Vertical Pattern

Horizontal Pattern

Vertical Pattern

PLANAR ANTENNA ASSEMBLY FIXED TO CEILING

BACKGROUND

1. Field of the Invention

The present invention relates to an antenna assembly for a mobile communication repeater, and more particularly, to a planar antenna assembly fixed to a ceiling, in which a structure of an antenna assembly for a mobile communication repeater is improved with a planar form using a planar antenna.

2. Discussion of Related Art

As most people currently possess personal mobile phones and an amount of use of radio waves is rapidly increasing due to the current use of smart phones, a large number of mobile communication repeaters for data communication are installed. However, because customers are not close to mobile communication repeaters in areas such as inside buildings in downtown areas, underground parking areas, offices, subway stations, tunnels, and the like, or due to structural problems in a building, transmission and reception of radio waves from and to the mobile communication repeaters are deficient, so that areas in which calls are difficult to establish may be generated. Such an area is referred to as a shadow area. In order to relieve customers' needs for quality of calls in the shadow area and process an amount of data, a mobile communication repeater may be installed in such a shadow area in which the call quality is poor.

In general, an antenna assembly for a mobile communication repeater includes an antenna which is a radio wave transmission and reception device and an antenna cover which is made of a material for protecting the antenna. An antenna assembly for a mobile communication repeater which is installed indoors to be used is installed in a ceiling or a wall, and in this instance, a structure and a size of the antenna assembly for a mobile communication repeater have a very important impact on interior aesthetics.

Since a conventional antenna assembly for a mobile communication repeater which is attached to a ceiling uses an antenna including a radiation element having a structure perpendicular to a ceiling, an antenna assembly for mobile communication repeaters which has a protruding structure is attached to the ceiling. The structure protruding from the ceiling is not aesthetically pleasing, and therefore the antenna assembly for a mobile communication repeater is difficult to install due to opposition from building owners. Thus, it is difficult to eliminate shadow areas in accordance with the needs of customers.

SUMMARY OF THE INVENTION

The present invention is directed to a planar antenna assembly which is attached to a ceiling, and in which a structure of an antenna assembly for a mobile communication repeater is developed into a planar form, thereby improving interior aesthetics.

In addition, the present invention is directed to a planar antenna assembly which is attached to a ceiling, and which improves electric characteristics of radio waves to improve call quality.

In addition, the present invention is directed to a planar antenna assembly which is attached to a ceiling, and in which an antenna having a structure parallel with a ceiling face is installed by adopting a half-wavelength dipole antenna of a printed circuit board installed in parallel with an installation face, and various types of patterns are processed on a surface of an upper cover for protecting the antenna, thereby improving aesthetics.

According to an aspect of the present invention, there is provided a planar antenna assembly attached to a ceiling, including: an antenna, a lower cover, and an upper cover. The antenna may be an antenna including a radiation element provided on both side surfaces of a printed circuit board installed in parallel with an installation surface. The lower cover may be formed into a planar shape, and installed in a lower portion of the antenna so as to fix and connect the antenna. The upper cover may be installed in an upper portion of the antenna, fastened to the lower cover so as to cover the antenna, and formed into a planar shape so as to provide an installation space of the antenna.

In addition, the antenna may be a half-wavelength dipole which is copper-foil printed on both of the side surfaces of the printed circuit board.

In addition, the radiation element may be formed into a circular shape, a rectangular shape, or a stepped shape.

In addition, the radiation element provided on one side surface of the printed circuit board and the radiation element provided on the other side surface thereof may share no common radiation surface.

In addition, the antenna may further include a spiral copper foil tail connected to the radiation element.

In addition, the planar antenna assembly may further include a connector for enabling the lower cover to be fastened to the ceiling and connecting a power feeding line.

In addition, the upper cover and the lower cover may include a coupling member which aligns coupling positions of an upper coupling hole formed in the upper cover and a lower coupling hole formed in the lower cover so as to fasten the upper cover and the lower cover, and fastens the upper cover and the lower cover.

In addition, a parasitic element may be additionally connected to the antenna.

According to an embodiment of the present invention, the planar antenna assembly attached to the ceiling may include an antenna based on the printed circuit board installed in parallel with the installation surface.

The planar antenna assembly attached to the ceiling may slightly protrude from the installation surface due to its high installation height.

In addition, by adopting the upper cover, an exterior of which can be processed to be attractive, protrusion from the ceiling or the wall may be minimized when the planar antenna assembly attached to the ceiling is assembled, and the exterior may be formed into various shapes, thereby improving interior aesthetics.

In addition, the dipole including the circular radiation element, the stepped radiation element, or the rectangular radiation element provided on both side surfaces of the printed circuit board may form the antenna to transmit and receive signals in a wide band frequency, thereby improving an existing shadow area and call quality. In addition, the spiral copper foil tail connected to the radiation element may affect an improvement of a standing wave ratio.

In addition, the antenna based on the small-sized printed circuit board may be used, thereby facilitating installation.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
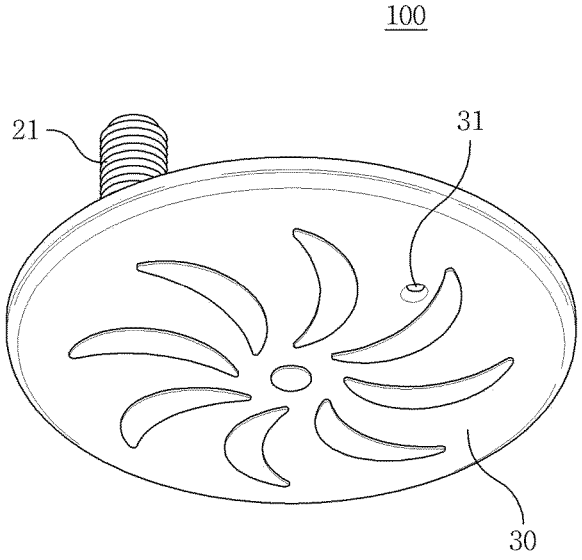
FIG. 1 is a perspective view showing a planar antenna assembly attached to a ceiling according to an embodiment of the present invention.

Example embodiments of the present invention are disclosed herein. However, specific structural and functional details disclosed herein are merely representative for purposes of describing example embodiments of the present invention, and example embodiments of the present invention may be embodied in many alternate forms and should not be construed as being limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention.

Hereinafter, embodiments of the present invention will be described in detail with reference to the accompanying drawings.

Figure 2:
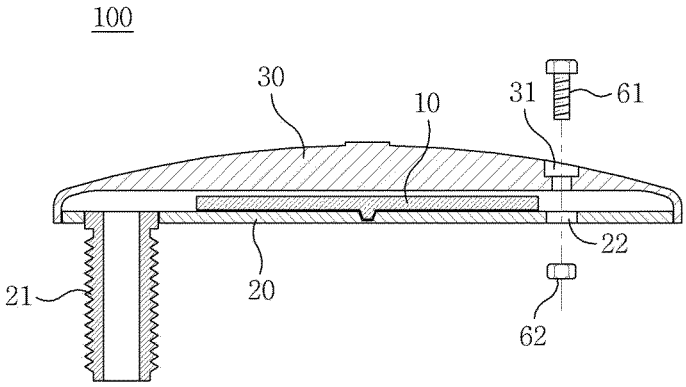
FIG. 2 is a cross-sectional view showing the planar antenna assembly of FIG. 1 attached to the ceiling.
Figure 3A:
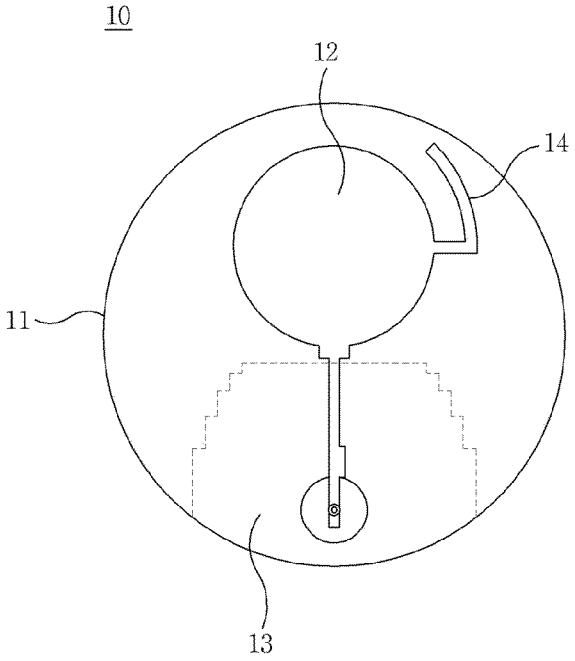
FIG. 3A is a plan view showing an antenna of FIG. 1.

FIG. 1 is a perspective view showing a planar antenna assembly 100 attached to a ceiling according to an embodiment of the present invention, FIG. 2 is a cross-sectional view showing the planar antenna assembly 100 of FIG. 1 attached to the ceiling, and FIG. 3A is a plan view showing an antenna 10 of FIG. 1.

Referring to FIGS. 1 to 3A, the antenna assembly 100 attached to the ceiling according to an embodiment of the present invention includes an antenna 10, a lower cover 20, and an upper cover 30. The antenna 10 includes radiation elements 12 and 13 provided on both side surfaces of a printed circuit board 11 installed in parallel with an installation surface. The lower cover 20 is formed into a planar shape, and installed in a lower portion of the antenna 10 so that the antenna 10 is fixed and connected to the lower cover 20. The upper cover 30 is formed into a planar shape, provides an installation space in which the antenna 10 is installed, and is fastened to the lower cover 20 so as to cover the antenna 10 for the purpose of protecting the antenna 10. In addition, the antenna assembly 100 may further include a connector that fastens the lower cover 20 and the installation surface.

Hereinafter, each component of the planar antenna assembly attached to the ceiling according to an embodiment of the present invention will be described in detail.

Figure 3B:
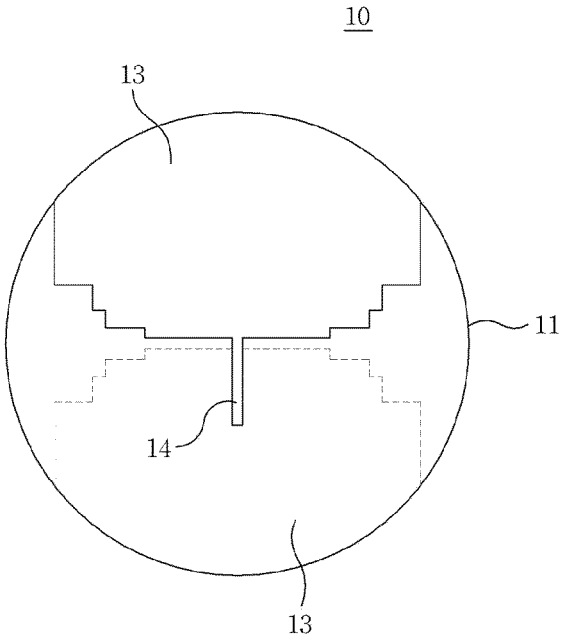
FIG. 3B is a plan view showing a planar antenna assembly attached to a ceiling according to another embodiment of the present invention.

The antenna 10 includes the radiation elements 12 and 13 provided on both of the side surfaces of the printed circuit board installed in parallel with the installation surface. A half-wavelength dipole forms the antenna 10 using the radiation elements 12 and 13 which are copper-foil printed, and the radiation elements are processed to have a circular shape, a rectangular shape, or a stepped shape. As shown in FIG. 3A, the copper foil printing is performed while the radiation elements 12 and 13 provided on both of the side surfaces of the printed circuit board share no radiation surface. The circular radiation element 12 is provided in one side surface of the printed circuit board 11, and the stepped radiation element or the rectangular radiation element 13 is provided in the opposite side surface thereof. In addition, the antenna 10 may further include a spiral copper foil tail 14 connected to the radiation elements 12 and 13. The connected spiral copper foil tail 14 may have an effect of improving a standing wave ratio of wide band characteristics. At least one spiral copper foil tail 14 may be connected, and connected to each of the radiation elements 12 and 13 provided on both of the side surfaces of the printed circuit board. Meanwhile, as shown in FIG. 3B, the antenna 10 may be formed in such a manner that the stepped radiation element 13 is copper-foil printed on both of the side surfaces.

The lower cover 20 is formed into a planar shape so that the lower cover 20 is brought into close contact with the ceiling. A structure including a groove or hole for fastening the lower cover 20 and the antenna 10 is formed on an upper surface of the lower cover 20. A hole that penetrates an upper surface and a lower surface of the lower cover 20 is formed in the lower surface of the lower cover 20 so that the lower cover 20 is fastened to the connector 21, and a cross-section of the hole is processed in the form of a nut. The lower cover 20 has a planar shape slightly larger than the antenna 10 in order to protect the antenna 10. The lower cover 20 may be provided in the form of a plate, and manufactured in various shapes such as a circle, a rectangle, a star, and the like.

Figure 4A:
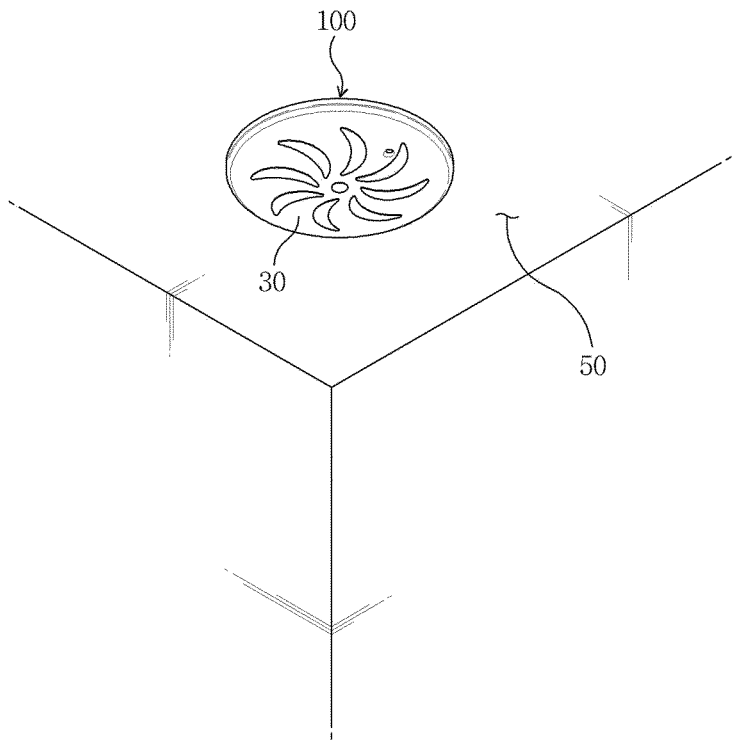
FIG. 4A is a perspective view showing an example in which a planar antenna assembly attached to a ceiling according to an embodiment of the present invention is installed in a ceiling.
Figure 4B:
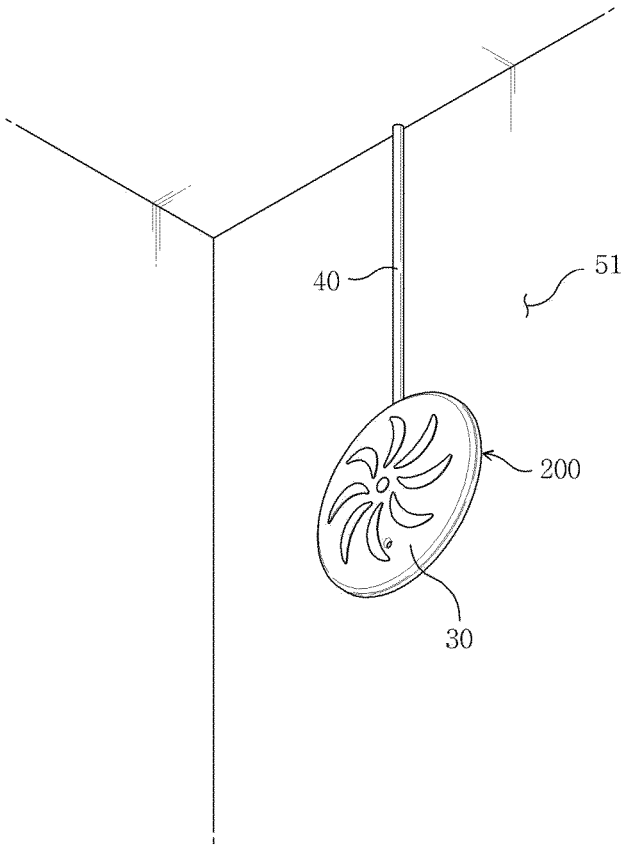
FIG. 4B is a perspective view showing an example in which a planar antenna assembly attached to a ceiling according to another embodiment of the present invention is installed in a wall.

The connector 21 is fastened to the hole which penetrates the upper and lower surfaces of the lower cover 20 to fix the planar antenna assembly 100 to the ceiling, and connects the antenna 10 and the power feeding line. The connector 21 is formed in a cylindrical shape, and is processed in the form of a bolt on an outer surface thereof to be fastened to the hole of the lower cover 20. The shape and fastening method of the connector 21 and a coupling position between the connector 21 and the lower cover 20 are not limited. In addition, the coupling position between the connector 21 and the lower cover 20 may be adjusted, so that a hole through which the connector 21 and the lower cover 20 are fastened with each other may be processed on one side surface of the lower cover 20. Meanwhile, a structure in which the planar antenna assembly 100 is fastened to a ceiling and a wall may be referred to as the connector 21. As shown in FIG. 4A, the planar antenna assembly 100 may be attached to a ceiling 50. For reference, the installation surface is not limited to the ceiling, and as shown in FIG. 4B, a planar antenna assembly 200 is connected to a coaxial cable 40 to be attached to a wall 51.

The upper cover 30 is installed in an upper portion of the antenna 10, and fastened to the lower cover 20 so as to cover the antenna 10 to provide an installation space in which the antenna 10 is installed. The upper cover 30 may be made of a non-conductive material having predetermined rigidity in order to protect the antenna 10. As described above, the upper cover 30 includes the antenna based on the printed circuit board 11, and therefore the upper cover 30 is formed in a planar shape. The shape of the upper cover 30 may be processed to have various shapes such as a circle, a rectangle, and the like. Thus, in the antenna assembly 100 according to an embodiment of the present invention, the use and appearance of the upper cover 30 may be formed in various manners, thereby improving interior aesthetics. For reference, the surface of the upper cover 30 may be processed to have various shapes such as a circle, a rectangle, a star, a triangle, and the like. Meanwhile, when the antenna assembly is installed in an area which does not require protrusion of the antenna assembly, the antenna assembly may be installed without the lower cover 20 and the upper cover 30.

An upper coupling hole 31 is formed in the form of a hole penetrating the upper cover 30 so as to fasten the upper cover 30 and the lower cover 20.

A lower coupling hole 22 is formed in the form of a hole penetrating the lower cover 20 so as to fasten the upper cover 30 and the lower cover 20.

A coupling member 60 includes a bolt 61 and a nut 62 which are used for assembling the lower and upper covers 20 and 30 of the planar antenna assembly 100. A position of the lower coupling hole 22 and a position of the upper coupling hole 31 are aligned with each other, and the upper cover 30 and the lower cover 20 may be fastened to each other using the bolt 61 and the nut 62. However, the coupling member 60 is not limited to the bolt 61 and the nut 62, and may include any coupling member which can couple the upper cover 30 and the lower cover 20. In addition, the shapes, types, and processing types of the upper coupling hole 31 and the lower coupling hole 22 are not limited.

Hereinafter, characteristics of radio waves irradiated from the planar antenna assembly 100 according to an embodiment of the present invention will be described in detail.

Figure 5:
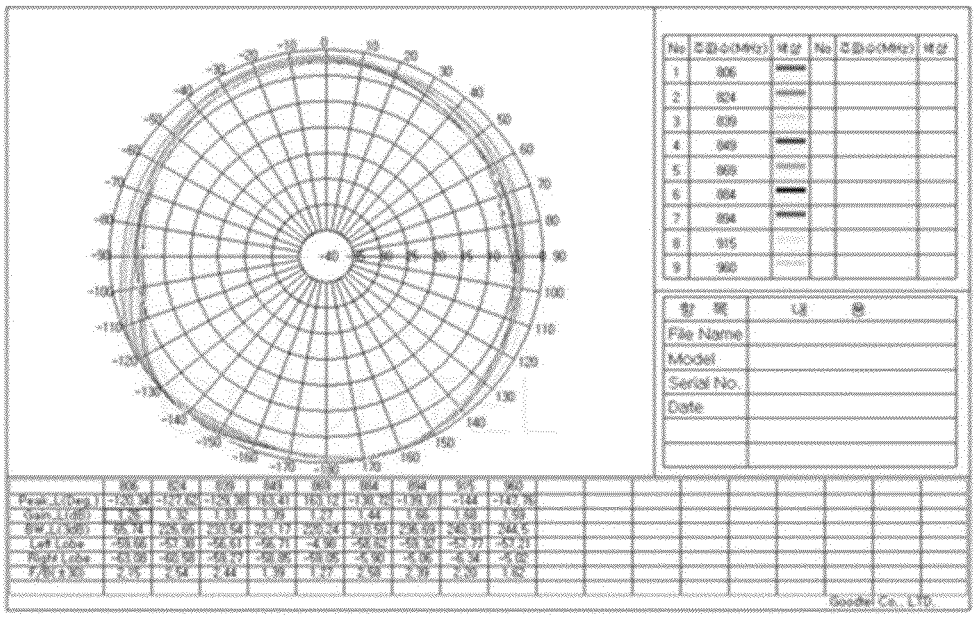
FIG. 5 is a graph showing an example of measuring a horizontal pattern of low-band radio waves (806 to 960 MHz) using a planar antenna assembly attached to a ceiling according to an embodiment of the present invention.
Figure 6:
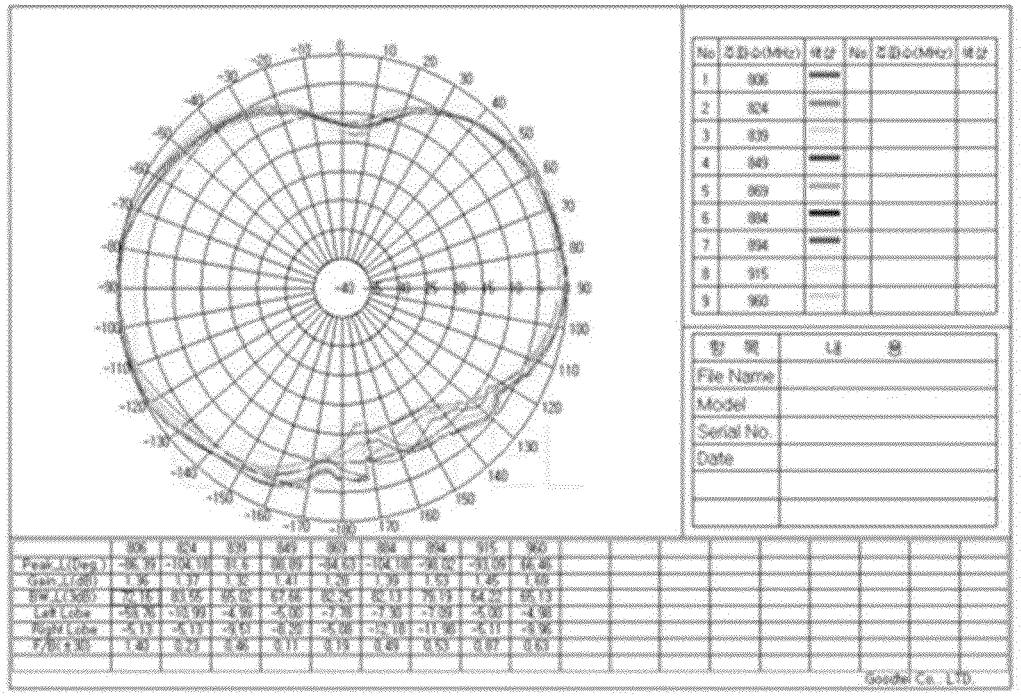
FIG. 6 is a graph showing an example of measuring a vertical pattern of low-band radio waves (806 to 960 MHz) using a planar antenna assembly attached to a ceiling according to an embodiment of the present invention.
Figure 7:
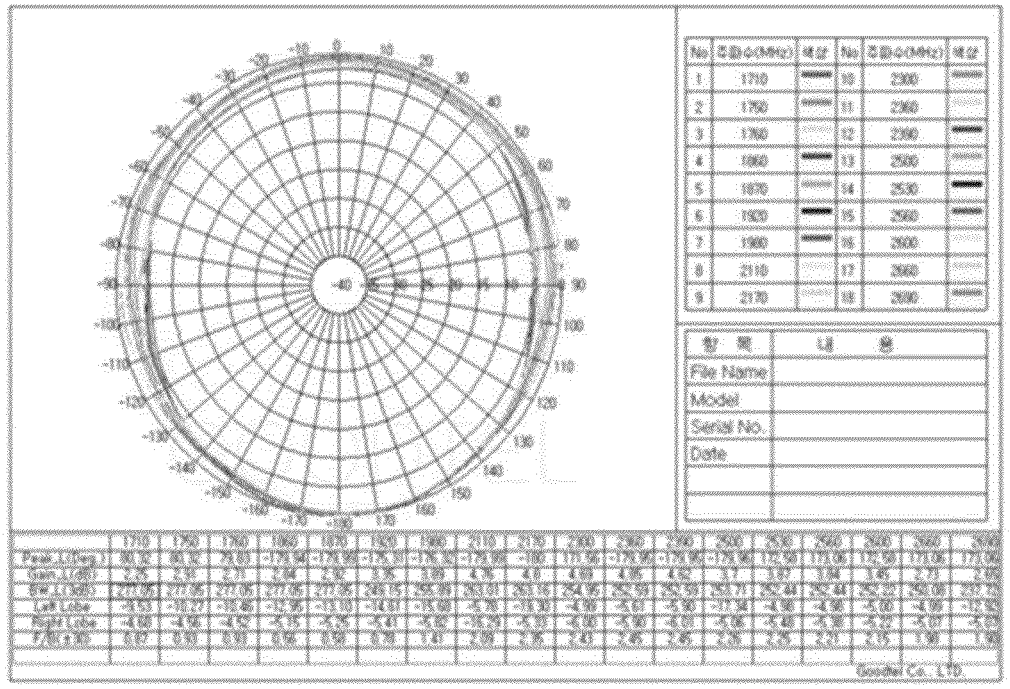
FIG. 7 is a graph showing an example of measuring a horizontal pattern of high-band radio waves (1700 to 2700 MHz) using a planar antenna assembly attached to a ceiling according to an embodiment of the present invention.
Figure 8:
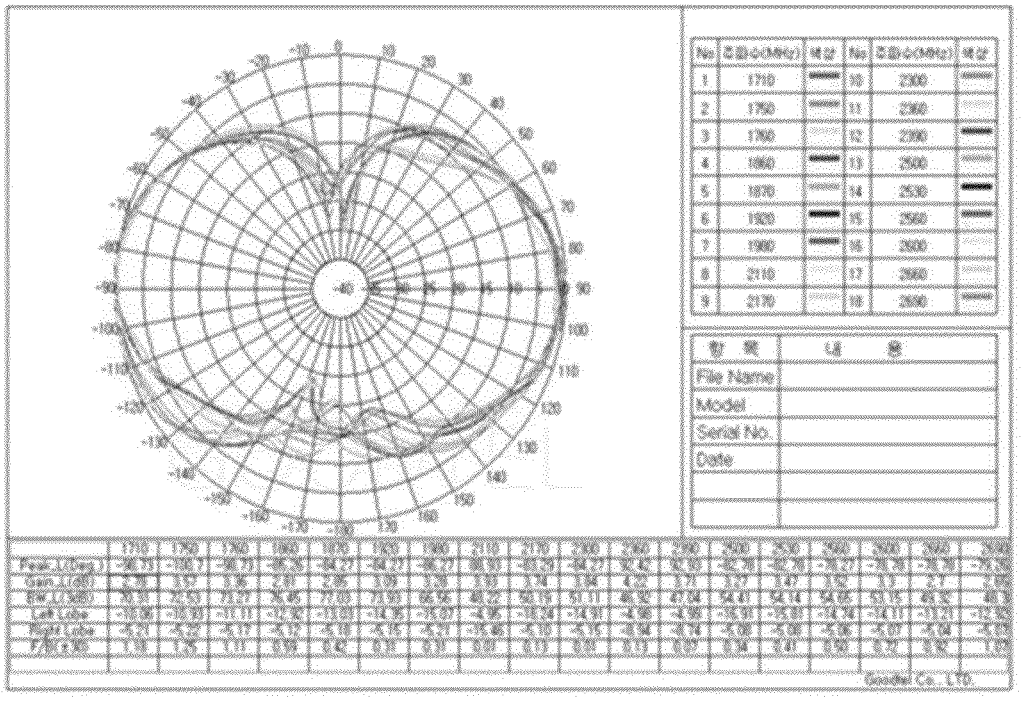
FIG. 8 is a graph showing an example of measuring a vertical pattern of high-band radio waves (1700 to 2700 MHz) using a planar antenna assembly attached to a ceiling according to an embodiment of the present invention.

FIG. 5 is a graph showing an example of measuring a horizontal pattern of low-band radio waves (806 to 960 MHz) using a planar antenna assembly attached to a ceiling according to an embodiment of the present invention, FIG. 6 is a graph showing an example of measuring a vertical pattern of low-band radio waves (806 to 960 MHz) using a planar antenna assembly attached to a ceiling according to an embodiment of the present invention, FIG. 7 is a graph showing an example of measuring a horizontal pattern of high-band radio waves (1700 to 2700 MHz) using a planar antenna assembly attached to a ceiling according to an embodiment of the present invention, and FIG. 8 is a graph showing an example of measuring a vertical pattern of high-band radio waves (1700 to 2700 MHz) using a planar antenna assembly attached to a ceiling according to an embodiment of the present invention.

Referring to FIGS. 5 to 8, non directivity of radio waves radiated by the antenna including the half-wavelength dipole in the planar antenna assembly according to an embodiment of the present invention can be identified.

Figure 9:
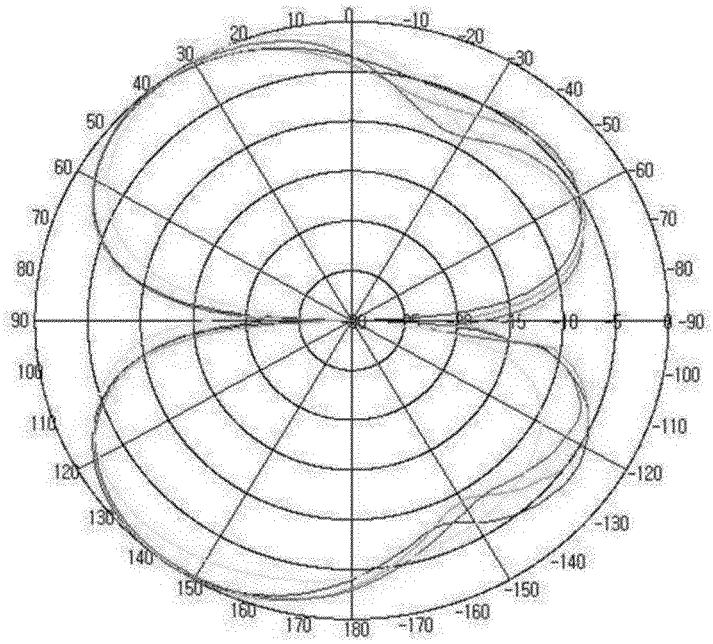
FIG. 9 is a graph showing an example of measuring a radiation pattern of radio waves using a conventional antenna assembly for a mobile communication repeater which is attached to a ceiling.
Figure 10:
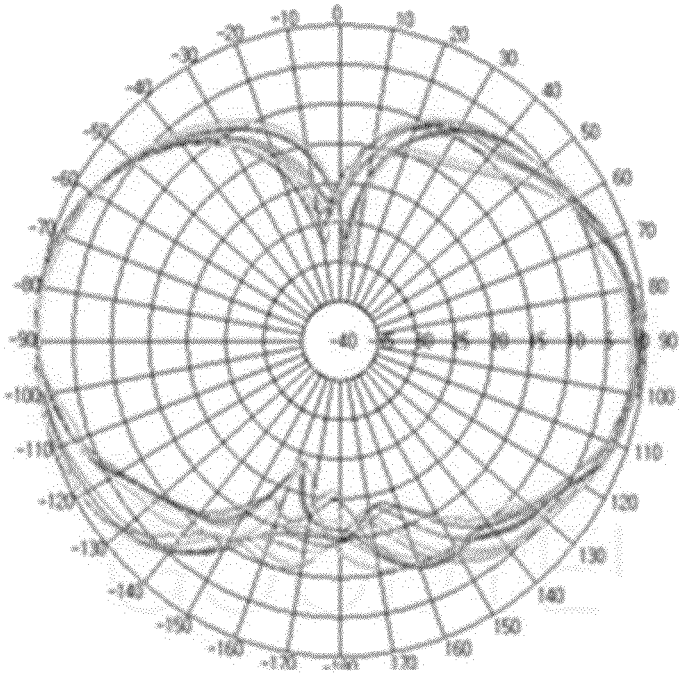
FIG. 10 is a graph showing an example of measuring a radiation pattern of radio waves using a planar antenna assembly attached to a ceiling according to an embodiment of the present invention.

Meanwhile, FIG. 9 is a graph showing an example of measuring a radiation pattern of radio waves using a conventional antenna assembly for a mobile communication repeater which is attached to a ceiling, and in FIG. 9, downward-oriented characteristics of high band appear. However, as shown in FIG. 10, referring to a graph showing an example of measuring a radiation pattern of radio waves using a planar antenna assembly attached to a ceiling according to an embodiment of the present invention, a vertical beam pattern of a high band is improved. In wideband frequencies over 806 to 2700 MHz, a radiation pattern is improved.

The frequency bands of the antenna provided in the antenna assembly attached to the ceiling according to an embodiment of the present invention in this manner may correspond to TRS (806 to 869 MHz), CDMA (824 to 894 MHz), GSM (890 to 960 MHz), PCS (1750 to 1870 MHz), WCDMA (1920 to 2170 MHz), WIBRO (2300 to 2400 MHz), WIFI (2400 to 2480 MHz), and DMB (2630 to 2655 MHz), and the antenna is available in frequency bands for each band.

Figure 11:
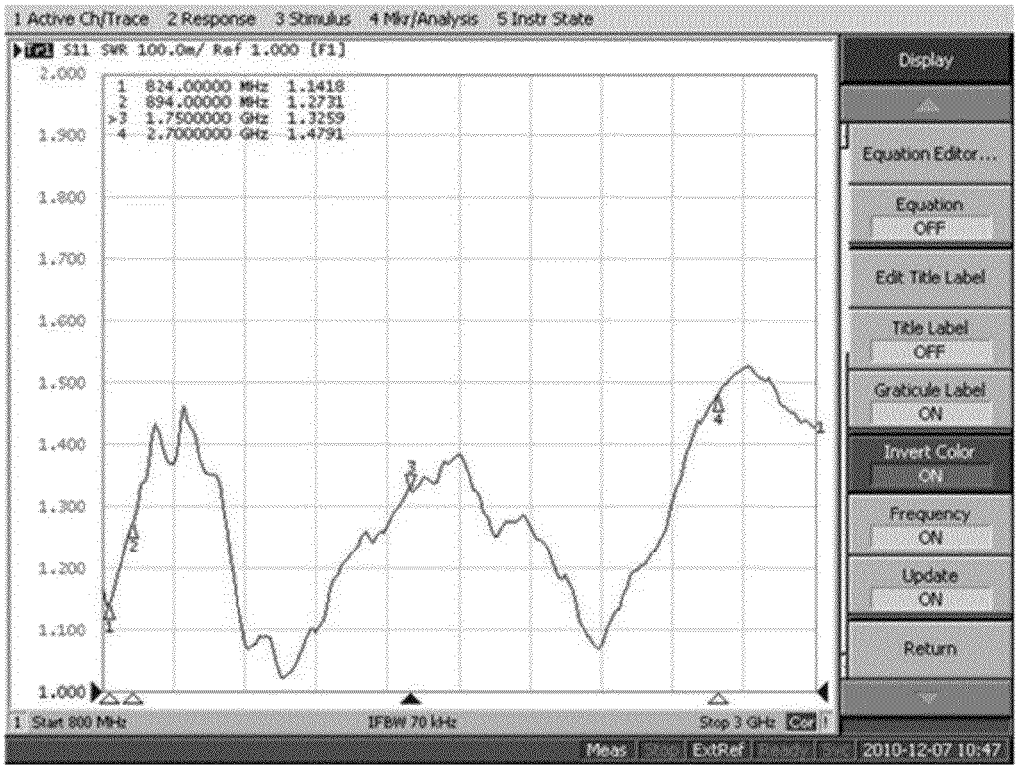
FIG. 11 is a graph showing a standing wave ratio of wide band characteristics using a planar antenna assembly attached to a ceiling according to an embodiment of the present invention.

For reference, FIG. 11 is a graph showing a standing wave ratio of wide band characteristics using a planar antenna assembly attached to a ceiling according to an embodiment of the present invention.

As described above, according to the embodiments of the present invention, the planar antenna assembly 100 attached to the ceiling may include the antenna 10 based on the printed circuit board 11 installed in parallel with the installation surface, and therefore the upper cover 30 may be formed into a planar shape, and the planar antenna assembly 100 attached to the ceiling may slightly protrude from the installation surface. In addition, a parasitic element may be additionally connected to the antenna 10.

By adopting the upper cover 30 made of a non-conductive material so that the exterior can be processed to be attractive, protrusion from the ceiling or the wall may be minimized when assembling the planar antenna assembly 100 attached to the ceiling, and the exterior may be formed into various shapes, thereby improving interior aesthetics. In addition, the dipole including the circular radiation element 12, the stepped radiation element, or the rectangular radiation element 13 provided on both of the side surfaces of the printed circuit board 11 may form the antenna 10 to transmit and receive signals in a wide band frequency, thereby improving an existing shadow area and call quality. In addition, the spiral copper foil tail 14 connected to the radiation element may contribute to an improvement of a standing wave ratio. Meanwhile, the antenna 10 based on the printed circuit board 11 may be used, so that a size of the antenna 10 may be reduced, thereby facilitating installation.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A planar antenna assembly, the assembly comprising:

an antenna which is disposed in parallel with an installation surface, and comprising a first radiation element and a second radiation element, wherein the first radiation element is disposed on a first surface of a printed circuit board, and wherein the second radiation element is disposed on a second, opposite surface of the printed circuit board;

a planar lower cover which is disposed in a lower portion of the antenna so that the antenna is fixed and connected with the planar lower cover; and a planar upper cover which is disposed in an upper portion of the antenna, is fastened to the lower cover, and covers the antenna to provide an installation space for the antenna, wherein each of the first and second radiation elements is a half-wavelength dipole which is copper-foil printed on the corresponding first or second surface of the printed circuit board, wherein, when the first radiation element on the first surface is projected onto the second surface, or, when the second radiation element on the second surface is projected onto the first surface, the first and second radiation elements do not mutually share a radiation surface.

2. The planar antenna assembly of claim 1, wherein at least one of the first and second radiation elements of the antenna has a circular shape, a rectangular shape, or a stepped shape.

3. The planar antenna assembly of claim 1, further comprising:

a connector which is coupled to the lower cover so that the lower cover is fastenable to the installation surface;

a hole disposed in the lower cover, and through which the connector extends.

4. The planar antenna assembly of claim 1, wherein the upper cover and the lower cover further comprises:

an upper coupling hole which is disposed in the upper cover;

a lower coupling hole which is disposed in the lower cover; and a coupling member which aligns coupling positions of the upper and lower coupling holes with each other, extends through the upper and lower coupling holes, and fastens the upper cover and the lower cover.

5. The planar antenna assembly of claim 1, wherein the antenna further comprises a parasitic element.

6. The planar antenna assembly of claim 1, wherein the antenna further comprises a spiral copper foil tail connected to at least one of the first and second radiation elements.

7. The planar antenna assembly of claim 1, wherein the first and second radiation elements have separated radiation surfaces which do not overlap each other.

8. The planar antenna assembly of claim 1, wherein the first radiation element has a circular shape, wherein the second radiation element has a stepped shape, and wherein the circular shape of the first radiation element and the stepped shape of the second radiation element do not overlap each other.

9. The planar antenna assembly of claim 1, wherein the first radiation element has a stepped shape, wherein the second radiation element has a stepped shape, and wherein the stepped shape of the first radiation element and the stepped shape of the second radiation element do not overlap each other.

* * * * *